US005408702A

United States Patent [19]

Chiang

[11] Patent Number: 5,408,702

[45] Date of Patent: Apr. 25, 1995

[54] SWIMMING GOGGLES

[76] Inventor: Herman Chiang, 11F-2, No. 634-9, Ching-Ping Rd., Chung-Ho City, Taipei Hsien, Taiwan, Prov. of China

[21] Appl. No.: 186,446

[22] Filed: Jan. 24, 1994

[51] Int. Cl.[6] ..... A61F 9/02

[52] U.S. Cl. ..... 2/428; 2/452

[58] Field of Search ..... 2/428, 430, 452, 440, 2/429; 351/43

[56] References Cited

U.S. PATENT DOCUMENTS

| | | | |
|---|---|---|---|
| 845,696 | 2/1907 | Cover | 2/440 |
| 3,483,569 | 12/1969 | Armendariz | 2/430 |
| 4,264,987 | 5/1981 | Runckel | 2/452 X |
| 5,303,428 | 4/1994 | Pernicka | 2/452 |

*Primary Examiner*—Peter Nerbun

[57] ABSTRACT

An improved pair of swimming goggles has a frame unit, two lens units formed integrally with the frame unit, a gasket unit including two gaskets, a head strap unit and an adjusting member. The frame unit has a rear portion and two opposite sides. Each of the two opposite sides of the frame unit is formed with a strap hole. The gaskets are mounted separately on the rear portion of the frame unit. The strap unit includes upper and lower straps. Each of the upper and lower straps has a first end secured removably to one of the opposite sides of the frame unit and a second end. The adjusting member is formed with two pairs of aligned adjusting holes. The second end of each of the upper and lower straps extends through the strap hole on the other one of the opposite sides of the frame unit and through a corresponding pair of the aligned adjusting holes of the adjusting member. The adjusting member is sized so as to prevent the extension thereof through the strap hole on the other one of the opposite sides of the frame unit.

3 Claims, 6 Drawing Sheets

SWIMMING GOGGLES

BACKGROUND OF THE INVENTION

1. Field Of The Invention

This invention relates to a pair of swimming goggles, more particularly to an improved pair of swimming goggles which can prevent the seepage of water thereinto when worn.

2. Description Of The Related Art

Referring to FIGS. 1, 2 and 3, a conventional pair of swimming goggles usually includes a frame unit 9, two lens units 91, a gasket unit and a head strap 8. The lens units 91 are formed integrally with frame unit 9 at a front portion of the latter. The frame unit 9 has two opposite sides formed with a respective strap hole 902. The gasket unit includes two gaskets 92. Each of the gaskets 92 is mounted on a rear portion of the frame unit 9 and is aligned with a corresponding one of the lens units 91. The head strap unit 8 comprises an upper strap 80 having a first end and a second end, and a lower strap 81 having a first end and a second end. The first ends of the upper and lower straps 80, 81 are connected together. The second ends of the upper and lower straps 80, 81 are also connected together. The strap unit 8 interconnects the two sides of the frame unit 9 by extending the first and second ends of the upper and lower straps 80, 81 through the two strap holes 902.

The aforementioned conventional pair of swimming goggles has the following drawbacks:

(a) Since the upper and lower straps 80, 81 are connected together at the first ends and at the second ends, the lengths of the upper and lower straps 80,81 between the two sides of the frame unit 9 are equal. Thus, movement of the upper strap 80 may result in undesired movement of the lower strap 81, thereby preventing the conventional pair of swimming goggles from accommodating the shape of a particular user's head.

(b) Since the face contacting surfaces of the gaskets 92 are not in tight contact with the user's face, a gap (not shown) will be formed between the user's face and each of the gaskets 92, thereby resulting in the seepage of water into the interior of the swimming goggles.

(c) Each of the portions 901 of the frame unit 9, which portions 901 are disposed between one of the lens units 91 and an adjacent one of the strap holes 902, are not subjected to optical polishing treatment, thereby limiting the scope of vision of the user.

SUMMARY OF THE INVENTION

Therefore, the main object of the present invention is to provide an improved pair of swimming goggles which can overcome the aforementioned drawbacks that are commonly associated with the prior art.

According to this invention, an improved pair of swimming goggles includes a frame unit, two lens units formed integrally with the frame unit on a front portion of the latter, a gasket unit including two gaskets, a head strap unit and an adjusting member. The frame unit has a rear portion and two opposite sides. Each of the two opposite sides of the frame unit is formed with a strap hole. The gaskets are mounted separately on the rear portion of the frame unit. The head strap unit includes upper and lower straps. Each of the upper and lower straps has a first end secured removably to one of the opposite sides of the frame unit and a second end. The adjusting member is formed with two pairs of aligned adjusting holes. The second end of each of the upper and lower straps extends through the strap hole on the other one of the opposite sides of the frame unit and through a corresponding pair of the aligned adjusting holes of the adjusting member. The adjusting member is sized to prevent extension thereof through the strap hole on the other one of the opposite sides of the frame unit.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
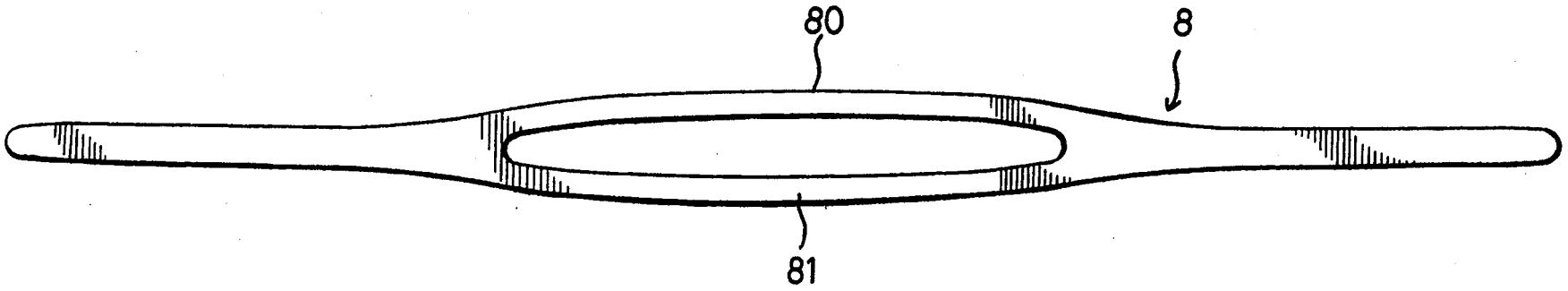
FIG. 1 (PRIOR ART)
FIG. 1 is a schematic view of a head strap unit of a conventional pair of swimming goggles.
Figure 2:
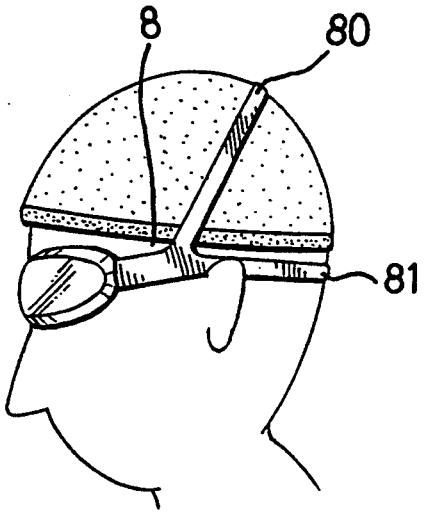
FIG. 2 (PRIOR ART)
FIG. 2 is a side view showing the conventional pair of swimming goggles when in use.
Figure 3:
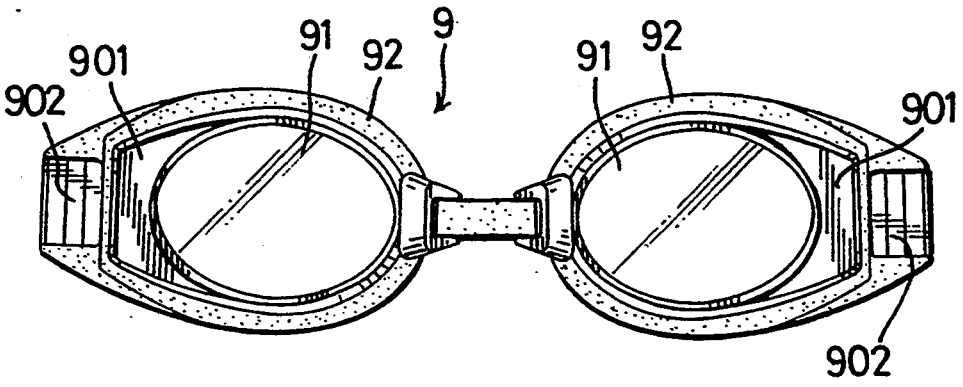
FIG. 3 (PRIOR ART)
FIG. 3 is a front view of the conventional pair of swimming goggles with the head strap unit being absent.
Figure 4:
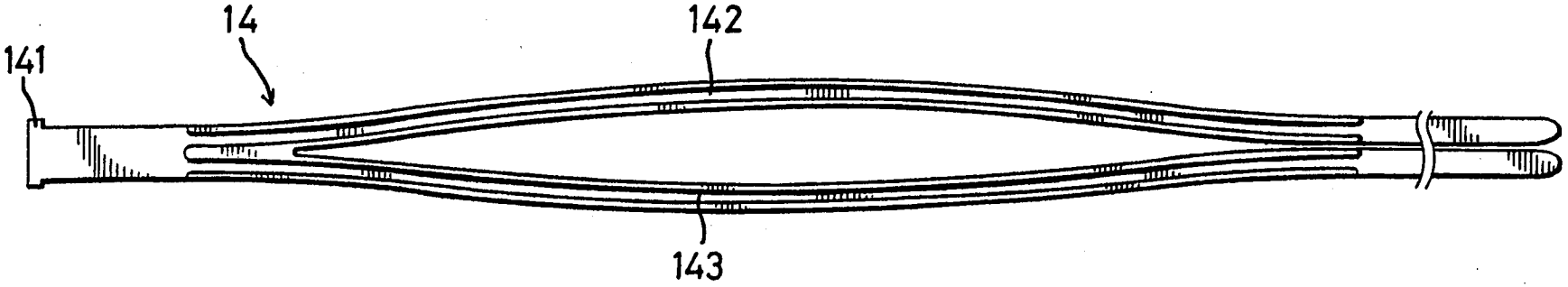
FIG. 4 is a schematic view of a head strap unit of a pair of swimming goggles according to the present invention.
Figure 5:
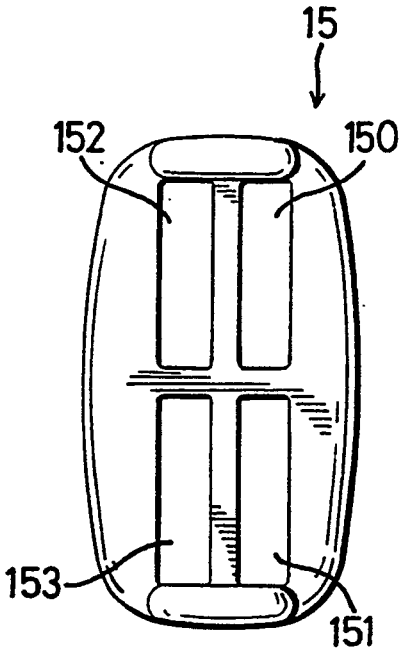
FIG. 5 is a schematic view of an adjusting member of the swimming goggles according to the present invention.

Referring to FIGS. 4 to 9, an improved pair of swimming goggles according to the present invention comprises a frame unit 10, two lens units 11, a gasket unit including two gaskets 12, a head strap unit 14, and an adjusting member 15.

The frame unit 10 has two opposite sides formed with a respective strap hole 1011. An upright pin 1012 is disposed adjacent to the strap hole 1011 on one of the opposite sides of the frame unit 10.

The two lens units 11 are formed integrally with the frame unit 10 on a front portion of the latter.

The gaskets 12 are mounted separately on a rear portion of the frame unit 10. Each of the gaskets 12 has a face contacting surface which is opposite to the corresponding one of the lens units 11 and further has an inner peripheral edge, an outer peripheral edge and a groove 121 formed between the inner and outer peripheral edges.

The strap unit 14 includes upper and lower straps 142, 143. Each of the upper and lower straps 142, 143 has a first end secured to a retaining member 141. Each of the upper and lower straps 142, 143 further has a second end. The retaining member 141 is sized so as to prevent the extension thereof through the strap hole 1011 of the frame unit 10 and is formed with a hook portion 1410 which engages removably the upright pin 1012 of the frame unit 10 so that the first ends of the upper and lower straps 142, 143 are retained removably on one of the sides of the frame unit 10.

Figure 6:
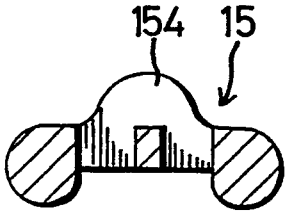
FIG. 6 is a sectional view of the adjusting member shown in FIG. 5.
Figure 7:
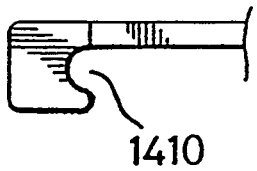
FIG. 7 is a schematic view showing a retaining member of the strap unit of the swimming goggles according to the present invention.
Figure 8:
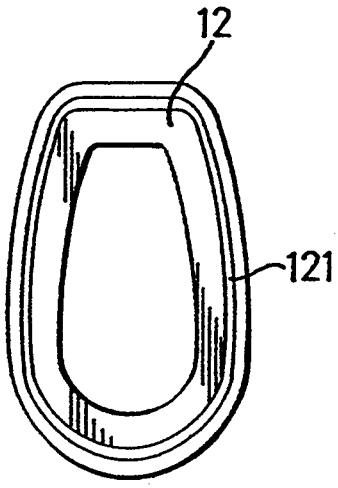
FIG. 8 is a schematic view showing the face contacting surface of the gasket unit of the swimming goggles according to the present invention.
Figure 9:
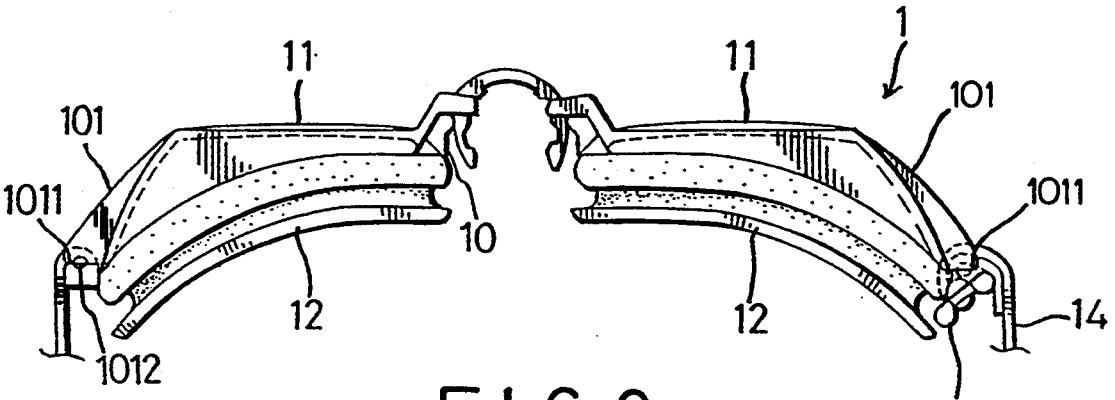
FIG. 9 is a side view showing the swimming goggles according to the present invention.

The adjusting member 15is formed with two pairs of aligned adjusting holes 150, 152 and 151, 153. The second end of each of the upper and lower straps 142, 143 extends through the strap hole 1011 on the other one of the opposite sides of the frame unit 10 and through a corresponding pair of the aligned adjusting holes 150, 152 and 151, 153 of the adjusting member 15. Thus, the lengths of the upper and lower straps 142, 143 of the strap unit 14 between the two opposite sides of the frame unit 10 can be adjusted independently. The adjusting member 15 is sized so as to prevent the extension thereof through the strap hole 1011 and has an upper end portion and a lower end portion. As seen in FIGS. 6 and 9, the adjusting member includes a swollen portion 154 that is wider than the adjustment strap hole. Each of the upper and lower end portions of the adjusting member 15 has a swollen surface 154 which abuts against the frame unit 10 to position the same when the present invention is in use.

Figure 10:
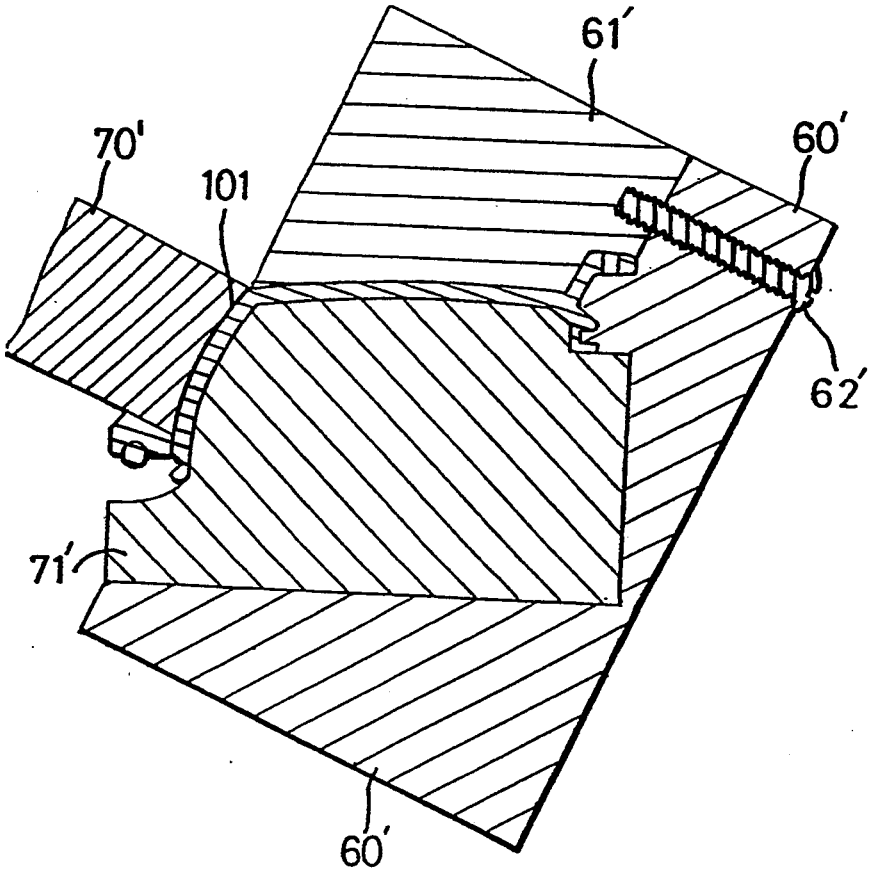
FIG. 10 is schematic view illustrating how a portion of the frame unit adjacent to the lens unit of the swimming goggles according to the present invention undergoes optical polishing treatment.

In use, the pair of swimming goggles according to the present invention is worn on the user's head in a manner similar to that of the previously described prior art. The hook portion 1410 of the retaining member 14 engages the upright pin 1012 of the frame unit 10. The retaining forces which are produced by the strap unit 14 for retaining the swimming goggles on the head of the user can be varied by adjusting separately the lengths of the upper and lower straps 142, 143 of the strap unit 14. Such an adjustment can be achieved by varying the distance traveled by the second ends of the upper and lower straps 142, 143 after being extended through the aligned adjusting holes 150, 152 and 151, 153 of the adjusting member 15. Moreover, the groove 121 in the face contacting surface of each gasket 12 permits the latter to act as a suction cap due to the air in the groove 121 which is expelled when the goggles are worn, thereby preventing the formation of a gap between the user's face and the face contacting surfaces of the gaskets 12. In the present invention, the lens units 11 had undergone optical polishing treatment by the method similar to that of the previously described prior art. However, portions 101 of the frame unit 10, which are respectively defined by one of the strap holes 1011 and an adjacent one of the lens units 11, have also undergone optical polishing treatment with the use of a special optical polishing apparatus shown in FIG. 10. The portion 101 of the frame unit 10 which is to be treated is supported by the supporting members 60', 61', 70', 71'. The supporting members 60', 61' are connected together by means of a locking bolt 62'. The supporting members 60', 61', 70',71' are rotated through an appropriate angle so that the portion 101 of the frame unit 10 can be subjected to optical polishing treatment, thereby increasing the scope of vision of the user when the swimming goggles of the present invention is in use.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A pair of swimming goggles, comprising:

a frame unit which has front and rear portions and two opposite sides, each of said two opposite sides of said frame unit is formed with a strap hole, a first strap hole is located at one of said two opposite sides of said frame unit and a second strap hole is located at the other one of said two opposite sides of said frame unit, said frame unit further including an upright pin adjacent to one of said strap holes, at least one lens unit formed integrally with said frame unit at said front portion, a gasket unit mounted on said rear portion of said frame unit, a head strap unit which interconnects said two opposite sides of said frame unit, said head strap unit including upper and lower straps, each of said upper and lower straps having a common first end secured to a retaining member having a hook portion, said hook portion removably secured to said upright pin and further having a second end, and an adjusting member formed with an upper pair of aligned adjusting holes and a lower pair of aligned adjusting holes, said second end of each of said upper and lower straps extending through the other of said first and second strap holes and through a corresponding pair of said upper and lower pairs of aligned adjusting holes of said adjusting member, said adjusting member being wider than said other of said first and second strap holes to prevent movement of said adjusting member through said other of said first and second strap holes.

2. A pair of swimming goggles as claimed in claim 1, wherein said gasket unit has a face contacting surface which is opposite to said at least one lens unit and which has an inner peripheral edge, an outer peripheral edge and a groove formed on said face contacting surface and between said inner and outer peripheral edges.

3. A pair of swimming goggles as claimed in claim 1, wherein each of said strap holes and an adjacent one of said lens units cooperatively define a frame portion therebetween, each of said frame portions being subjected to optical polishing treatment.

* * * * *